United States Patent [19]

Schmid et al.

[11] Patent Number: 4,937,011

[45] Date of Patent: Jun. 26, 1990

[54] DETERGENT COMPOSITIONS CONTAINING ACTIVE CHLORINE AND KETONE FOAM INHIBITORS

[75] Inventors: Karl-Heinz Schmid, Mettmann; Adolf Asbeck, Duesseldorf; Christoph Breucker, Wuelfrath; Bernhard Gutsche, Hilden; Alfred Meffert, Monheim; Horst Rutzen, Langenfeld, all of Fed. Rep. of Germany

[73] Assignee: Henkel Kommanditgesellschaft auf Aktien, Duesseldorf, Fed. Rep. of Germany

[21] Appl. No.: 295,880

[22] Filed: Jan. 11, 1989

[30] Foreign Application Priority Data

Jan. 11, 1988 [DE] Fed. Rep. of Germany ..... 3800483

[51] Int. Cl.[5] ..... C11D 3/08; C11D 3/20; C11D 3/395

[52] U.S. Cl. ..... 252/99; 252/103; 252/312; 252/321

[58] Field of Search ..... 252/95, 99, 103, 321, 252/312

[56] References Cited

U.S. PATENT DOCUMENTS

| | | | |
|---|---|---|---|
| 4,087,398 | 5/1978 | Heyden et al. | 252/321 |
| 4,105,573 | 8/1978 | Jacobsen | 252/99 |
| 4,199,468 | 4/1980 | Barford et al. | 252/103 |

OTHER PUBLICATIONS

Advanced Organic Chemistry, Second Edition, Part B, Reactions and Synthesis, pp. 159–161.

*Primary Examiner*—Prince E. Willis
*Attorney, Agent, or Firm*—Ernest G. Szoke; Wayne C. Jaeschke; Real J. Grandmaison

[57] ABSTRACT

Alkaline dishwashing machine detergent compositions containing an active chlorine composition and a foam inhibiting amount of a ketone containing at least 25 carbon atoms. A process for their preparation wherein the ketone is introduced into the composition as a dispersion in a liquid.

19 Claims, No Drawings

DETERGENT COMPOSITIONS CONTAINING ACTIVE CHLORINE AND KETONE FOAM INHIBITORS

BACKGROUND OF THE INVENTION

1. Field of the Invention

The invention is an improvement in alkaline detergents containing active chlorine which are particularly suitable for use in machines. Examples of such detergents are dishwashing machine detergents although the invention is not limited to dishwashing detergents.

Shaped, granulated or liquid alkaline detergents which comprise builders, alkali metal silicates, alkali metal carbonates and/or alkaline metal hydroxides and which additionally contain active chlorine compounds are normally used in dishwashing machines. An anti-foam agent is generally added to prevent excessive foaming.

The detergents are generally produced by mixing of powder-form or particulate constituents. The liquid constituents, for example nonionic surfactants and/or aqueous alkaline silicate solutions, are generally sprayed onto an agitated powder mixture or onto parts of the powder or added in the mixer. Granulation may take place at the same time.

The active chlorine compounds are generally added as the last constituent of the mixture. The end product required has a powder-form or granular quality which is free-flowing, does not cake in storage under normal conditions and has a long shelf life, particularly in regard to the active chlorine content.

2. STATEMENT OF RELATED ART

Polychlorinated cyanuric acids and salts thereof, particularly trichloroisocyanuric acid, have been successfully used as active chlorine compounds in powder-form, granulated, liquid or liquid/paste-form dishwashing detergents. Hitherto, low-foaming nonionic surfactants have generally been used as anti-foam agents although they are attended by the disadvantage of only limited stability in storage in the dishwashing detergents. This disadvantage manifests itself in two ways. First, the nonionic surfactants used as antifoam agents, which correspond to the scheme fatty alcohol-$EO_x$-$PO_y$ or oxo alcohol-$EO_x$-$PO_y$ or EO/PO block polymers, undergo chemical decomposition during storage of the detergents and lose their anti-foam effect. In addition, the decomposition products formed lead to vigorous foaming in the majority of cases. Second, dishwashing detergents containing active chlorine providing compound when stored for several weeks, suffer a loss of effective active chlorine. Accordingly, their cleaning power, for example with respect to tea stains, is reduced.

SUMMARY OF THE INVENTION

It has now been unexpectedly discovered that certain ketones represent effective anti-foam agents in detergents containing active chlorine providing compositions since they are not destroyed by the active chlorine compounds and do not reduce the active chlorine content of the detergents or damage the active chlorine compounds. The invention comprises washing compositions containing the ketones and methods for preparing the dishwashing compositions.

Accordingly, the present invention is an alkaline washing composition containing active chlorine and ketones having long-chain alkyl or alkenyl radicals and containing a total of at least 25 carbon atoms in the molecule as chlorine-stable foam inhibitors, and particularly a dishwashing detergent, containing active chlorine. In the context of the invention, detergents containing active chlorine are understood in particular, to be detergents containing chlorinated cyanuric acid and salts thereof, particularly trichloroisocyanuric acid or dichloroisocyanuric acid in the form of the Na or K salts. In another embodiment, the invention relates to detergents, more especially dishwashing detergents of the stated type, which contain active chlorine and which are characterized as containing the above-defined ketones containing at least 25 carbon atoms as chlorine-stable form inhibitors.

DETAILED DESCRIPTION OF THE INVENTION

Long-chain ketones of the type in question here and their production are known, for example from DE-OS No. 25 53 990. The ketones are prepared by catalytic elimination of $CO_2$ and water from higher monocarboxylic acids, more particularly relatively high molecular weight fatty acids or salts thereof. Their use as special foam control agents in the paint, paper and food industries is described in DE-OS No. 25 53 990. In addition, it is known from DE No. 14 67 613 and DE No. 22 42 541 that ketones can be used as foam inhibitors in soap-containing detergents. However, in the absence of soaps and additional foam inhibitors, such as acetals and ketals, their effect in such detergents in unsatisfactory. Soaps act as high foamers in alkaline dishwashing detergents, and are therefore unsuitable for machine dishwashing detergents. Accordingly, it was not known, that the ketones useful in the present invention would be suitable as particularly stable foam inhibitors in dishwashing and similar detergents which normally are highly alkaline, contain active chlorine and are substantially free from soaps.

Preferred ketones are those obtained by reaction of linear or branched, saturated or unsaturated carboxylic acids or carboxylic acid mixtures in which the carboxylic acids or some of them contain more than 12 carbon atoms and, in particular, have a carbon chain length of $C_{14}$ to $C_{30}$ and, on ketonization, react with water with elimination of carbon dioxide. Particularly preferred ketones are those obtained by the ketonization of $C_{16}$–$C_{22}$ carboxylic acids or carboxylic acid salts and mixtures thereof. The preparation of the ketones may normally be carried out at temperatures in the range from about 200° to 350° C. in the presence of metal oxides or fatty acid/metal compounds. It is possible to use both starting materials containing a uniform number of carbon atoms and also fatty acid mixtures of natural origin. These mixtures may also contain carboxylic acids containing 12 carbon atoms or less, providing a major portion of the fatty acids present contain 14 or more carbon atoms.

Mixtures of symmetrical and asymmetrical ketones are formed in which the asymmetrical ketones, commensurate with the material used, may have chain lengths other than $C_{14}$ or $C_{12}$, provided that a relatively long-chain radical is present in the molecule so that the total number of carbon atoms on average is at least about 25. Examples are heptacosanone-14, hentriacontanone-16, pentatriacontanone-18, nonatriacontanone-20, triatetracontanone-22 or nonacosanone-15, tritriacontanone-17, heptatriacontanone-19, hentetracontanone-21 and the like.

Ketones or ketone mixtures useful in the present invention are normally solid at room temperature and have melting points in the range from 60° to 105° C. To make them easier to process, and to improve their foam-inhibiting effect, it is preferred to disperse the ketones in a liquid carrier. Free-flowing dispersions of finely divided foam inhibitors in suitable liquid carriers may readily be incorporated in the alkaline dishwashing detergents containing active chlorine. In addition to water, suitable liquid phases are preferably organic carriers which have a low pour point or melting point of lower than about 5° C. It is also preferable to use free-flowing carriers or carrier mixtures which have a comparatively high viscosity and contribute stabilization of the dispersions. The liquid carrier phase may also have a foam-inhibiting effect or may be used solely as a carrier for the foam inhibitor of the invention.

Particularly useful organic carrier liquids, which have an additional foam-inhibiting effect, are mineral oils having a boiling point above 140° C. and branched alcohols containing 8 to 24 carbon atoms, such as 2-hexyl-1-decanol or 2-octyl-2-dodecanol. Other useful foam-inhibiting carrier liquids are liquid esters of branched or unsaturated fatty acids containing 8 to 18 carbon atoms with monohydric or polyhydric alcohols, for example glycol diesters or glycerol triesters of oleic acid, isostearic acid; esters based on branched-chain or unsaturated, liquid fatty alcohols containing 8 to 18 carbon atoms, for example isotridecyl alcohol or oleyl alcohol. Mixtures of these carriers may also be used.

It is preferred to use organic carriers in which the ketones are soluble at elevated temperature and precipitate in finely divided form on cooling. To this end, the components are heated, a solution formed and then rapidly cooled with intensive stirring. Stable dispersions of finely divided foam inhibitors are formed. However, dispersions may also be prepared by stirring the finely ground, wax-like ketone or ketone mixture into the liquid phase.

The dispersions to be processed preferably contain about 5 to about 15% by weight of the ketone or mixtures of ketones. In addition, the dispersion of the ketone in the liquid carrier may be stabilized by suitable additives. Suitable additives are, for example, magnesium stearate, calcium stearate or aluminium stearate in quantities of from about 0.3 to 3.0% by weight.

In amounts of from 0.01 to 2% by weight, the foam inhibitors and foam inhibitor mixtures added to the alkaline detergents containing active chlorine provide a satisfactory foam-inhibiting effect. They are preferably present in quantities of not higher than about 1% by weight, based on dry detergent. In a particularly preferred embodiment, the ketone-based foam inhibitor is present in a quantity of from 0.05 to 0.5% by weight, based on the detergent.

Accordingly, dishwashing detergents, containing the foam inhibitors of the invention, have the following composition (based on anhydrous substance):

(A) 35–65% by weight and preferably 40–60% by weight sodium metasilicate having the composition $Na_2O:SiO_2=1:0.8-1:1.1$, (B) 0–40% by weight and preferably 5–30% by weight sodium tripolyphosphate, (C) 0–10% by weight finely divided, water-containing zeolite of the NaA type, (D) 0–15% by weight and preferably 0–5% by weight of at least one polyanionic complexing agent from the group consisting of polymeric or copolymeric polycarboxylic acids, hydroxyalkane polyphosphonic acids and aminoalkane polyphosphonic acids, in each case in the form of an alkali metal salt and preferably the sodium salt, (E) 0–20% by weight and preferably 3–15% by weight sodium carbonate, (F) 0–10% by weight and preferably 0–5% by weight sodium hydroxide, (G) 0–10% by weight and preferably 0.5–5% by weight sodium silicate (waterglass) having the composition $Na_2O:SiO_2=1:3-1:3.5$, (H) 0.2–5% by weight and preferably 0.5–3% by weight active chlorine compound, preferably trichloroisocyanuric acid or Na or K dichloroisocyanurate, (I) 0.01–2% by weight and preferably 0.05–0.5% by weight of the foam inhibitor of to the invention.

The detergents can contain sodium polyphosphate (Na-TPP) or may be phosphate-free. In cases where phosphate reduction is desirable on ecological grounds, the Na-TPP may be partially replaced by zeolite or by combinations of zeolite with polyanionic cobuilders. The Na-TPP content of such detergents may be up to 25% by weight, but is preferably less than 20% by weight. The Na-TPP is used as the hexahydrate to provide and complete solubility in the detergents according to the invention.

Suitable finely crystalline, synthetic, water-containing zeolites of the NaA type have a calcium binding power of from 100 to 200 mg CaO/g (in accordance with the data in DE No. 22 24 837). Their mean particle size (size distribution, as measured with a Coulter Counter) is normally in the range from 1 to 10 μm. The content of the zeolites in the detergent is up to 10%.

The zeolite is preferably used together with polyanionic co-builders. The polyanionic co-builders include compounds such as polyphosphonic acids and homopolymeric or copolymeric polycarboxylic acids derived from acrylic acid, methacrylic acid, maleic acid and olefinically unsaturated copolymerizable compounds.

Suitable phosphonic acids or phosphonic acid salts are 1-hydroxyethane-1,1-diphosphonate, ethylenediamine tetramethylene phosphonate (EDTMP) and diethylene triamine pentamethylene phosphonate, which are generally used in the form of their sodium salts and mixtures. The quantities used are normally up to 1.5% by weight, based on the detergent, and are preferably between 0.1 and 0.8% by weight, based on the free acid.

Suitable polymeric acids are homopolymers of acrylic acid and methacrylic acid, copolymers of acrylic acid with methacrylic acid and copolymers of acrylic acid, methacrylic acid or maleic acid with vinyl ethers, such as vinyl methyl ether or vinyl ethyl ether; with vinyl esters, such as vinyl acetate or vinyl propionate, acrylamide, methacrylamide, and with ethylene, propylene or styrene. In copolymeric acids in which one of the components has no acid function, their content is not higher than 70 mol-% and preferably less than 60 mol-% to provide adequate solubility in water. Copolymers of acrylic acid or methacrylic acid with maleic acid, of as characterized for example in EP No. 25 551-B 1, have proved to be particularly effective. The copolymers contain 50 to 90% by weight acrylic acid and have a molecular weight of from 20,000 to 150,000.

The production of the foam-inhibited detergents and the incorporation of the foam inhibitor or foam inhibitor dispersion, may be carried out by co-mixing the dry constituents with addition of the foam inhibitor dispersion, by mixing under granulating conditions, i.e. simultaneous application of water or a waterglass solution to the dry premix or by subsequent mixing or spraying of the foam inhibitor dispersion onto preformed granulate. The method of production and the order in which the individual constituents are added are not critical to the effect of the foam inhibitor or to the interaction between foam inhibitor and active chlorine compound.

EXAMPLES

The foam inhibitors of Examples 1 and 2 according to the invention and Comparison Examples 3 and 4 were each added to the following basic formulation:

5.0 kg sodium metasilicate, anhydrous
3.7 kg pentasodium tripolyphosphate hexahydrate
0.7 kg sodium carbonate, anhydrous
0.2 kg waterglass ($Na_2O:SiO_2=1:33$) in 0.3 kg water
0.1 kg trichloroisocyanuric acid
0.3 kg foam inhibitor of Examples 1 to 4.

The components were mixed and granulated for 10 minutes at 20° C. in a rotating drum while, while, the waterglass solution was sprayed on.

Foam inhibitor of Example 1

89.6% by weight mineral oil
7.0% by weight "ketone A"
3.0% by weight reaction product from the alkoxylation of polypropylene glycol (MW 2020) with 34 mol ethylene oxide and subsequent esterification of the terminal hydroxyl groups with stearic acid
0.4% by weight aluminium distearate

Foam inhibitor of Example 2

94.6% by weight 2-octyl-1-dodecanol
5.0% by weight "ketone A"
0.4% by weight magnesium distearate "Ketone A" used in Examples 1 and 2 was the reaction product of 2 mol of a mixture of saturated fatty acids with elimination of 1 mol carbon dioxide and 1 mol water, the substantially saturated fatty acid mixture used had the following carbon chain distribution: 0.5% $C_{12}$, 4.0% $C_{14}$, 25.0% $C_{16}$, 49.0% $C_{18}$, 11.0% $C_{22}$, 10.0% $C_{22}$, 0.5% $C_{24}$.

The ketones were dispersed in the carrier mixture heated to 80° C., after which the mixture was rapidly cooled with stirring to room temperature.

Comparison Example 3

A $C_{12}$–$C_{14}$ fatty alcohol reacted with 2 mols ethylene oxide and then with 4 mol propylene oxide was used as the foam inhibitor.

Comparison Example 4

A $C_{12}$–$C_{18}$ a fatty alcohol reacted with 5 mols ethylene oxide and then with 8 mol propylene oxide was used as foam inhibitor.

The foam-inhibiting effect was tested in a detergent solution containing egg white and egg yolk of fresh eggs as foam promotor. The test method was as follows:

Two Eggs (approx. 100 to 110 g) were diluted with water (16° German hardness, 160 mg CaO per liter) in a ratio of 1:1 and mixed for 2 minutes in an electrical mixer. 100 g of the emulsion were then made up with water to a volume of 500 ml in a double-walled 2000-ml measuring cylinder and heated to 50° C. On reaching the test temperature, quantities of 20 g of the dishwashing detergents to be tested of Examples 1 to 4 were added to the mixture. The solution was pumped from the bottom of the measuring cylinder through a glass tube by means of a laboratory peristaltic pump. The liquid was returned through a second tube, the lower end of which terminated level with the top edge of the measuring cylinder. The liquid was pump-circulated at a rate of 4 liters/minute and dropped back into the measuring cylinder, generating foam. The volumes of foam which formed from foam+liquid after intervals of 5, 10, 20 and 30 minutes were determined after those intervals.

The foam-inhibiting effect of the dishwashing detergents tested, as measured by the volume of foam+liquid phase, and the active chlorine content as measured by iodometric titration were determined immediately after production of the particular dishwashing detergent and after storage at 40° C. for periods of 1, 2 and 3 months. The values obtained are shown in the following Table.

The results of the tests clearly show that the dishwashing detergents of Examples 1 and 2 prepared with the foam inhibitors of the invention were almost as effective in their foam-inhibiting effect after storage for 3 months as they were immediately after their production. The active chlorine loss after storage for 3 months was at most 33%.

The dishwashing detergents formulated with the foam inhibitors of Comparison Examples 3 and 4 provided a much lower foam-inhibiting effect after storage for one month. The loss of active chlorine was 74 and 79%, respectively, after storage for only one month.

TABLE

The values obtained are shown in the following Table.

| Dishwashing detergent containing foam inhibitor of Example no. | Testing after x months' storage | Volumes (ml) foam + liquid 5 mins. | 10 mins. | 20 mins. | 30 mins. | % active chlorine content | Loss % |
|---|---|---|---|---|---|---|---|
| Example 1 | immediately after production | 560 | 620 | 720 | 880 | 0.81 | 0 |
| | 1 month | 600 | 660 | 700 | 800 | 0.78 | 4 |
| | 3 months | 660 | 1060 | 1060 | 1080 | 0.67 | 17 |
| Example 2 | immediately after production | 640 | 680 | 680 | 720 | 0.94 | 0 |
| | 1 month | 640 | 680 | 700 | 740 | 0.72 | 23 |
| | 3 months | 660 | 700 | 700 | 740 | 0.63 | 33 |
| Comparison Example 3 | immediately after production | 700 | 940 | 2000 | over-foamed | 0.89 | 0 |
| | 1 month | 940 | 2000 | over-foamed | over-foamed | 0.45 | 74 |
| Comparison Example 4 | immediately after | 560 | 560 | 700 | 1100 | 0.83 | 0 |

TABLE-continued

The values obtained are shown in the following Table.

| Dishwashing detergent containing foam inhibitor of Example no. | Testing after x months' storage | Volumes (ml) foam + liquid 5 mins. | 10 | 20 | 30 | % active chlorine content | Loss % |
|---|---|---|---|---|---|---|---|
| | production 1 month | 560 | 600 | 780 | 2000 | 0.17 | 79 |

We claim:

1. An alkaline dishwashing machine detergent composition comprising:
(A) 35–65% by weight sodium metasilicate having an $Na_2$:$SiO_2$ ratio of 1:0.8 to 1:11;
(B) 0–40% by weight sodium tripolyphosphate;
(C) 0–10% by weight finely divided zeolite NaA type;
(D) 0–15% by weight of an alkali metal salt of at least one polyanionic complexing agent selected from the group consisting of polymeric polycarboxylic acids and copolymeric polycarboxylic acids; hydroxyalkane polyphosphonic acids, aminoalkane polyphosphonic acids;
(E) 0–2% by weight of sodium carbonate;
(F) 0–10% by weight sodium hydroxide;
(G) 0–10% by weight of sodium silicate having a ratio of $Na_2O$:$SiO_2$ of from 1:3 to 1:3.5;
(H) 0.2–5% by weight of an active chlorine providing composition; and
(I) a foam inhibiting amount of at least one chlorine-stable, foam inhibiting ketone having a long chain aliphatic radical containing at least 25 carbon atoms.

2. A composition of claim 1 wherein the ketone is obtained by the ketonization of at least one straight or branched chain, saturated or unsaturated carboxylic acid containing more than about 12 carbon atoms.

3. A composition of claim 2 wherein the ketone is obtained by the ketonization of at least one carboxylic acid having from about 14 to about 30 carbon atoms.

4. A composition of claim 2 wherein the carobxylic acid contains from 16 to 22 carbon atoms.

5. A composition of claim 1 containing from about 0.01 to about 2% by weight the ketone based on the weight of the dry detergent.

6. A composition of claim 1 containing from about 0.05 to about 0.5% by weight of the ketone based on the weight of the dry detergent.

7. A composition of claim 1 wherein the ketone is added to the detergent as a finely divided dispersion in a liquid.

8. A composition of claim 7 wherein the liquid comprises water.

9. A composition of claim 7 wherein the liquid comprises an organic carrier.

10. A composition of claim 9 wherein the dispersion comprises from about 5% to about 15% by weight of ketone.

11. A composition of claim 7 wherein the liquid comprises at least one member selected from the group consisting of mineral oil having a boiling point above 140° C. and branched chain fatty alcohol containing 8 to 24 carbon atoms.

12. A composition of claim 1 comprising:
(A) 40–60% by weight sodium metasilicate;
(B) 5–30% by weight sodium tripolyphosphate;
(C) 0–10% by weight finely divided, water containing NaA type zeolite;
(D) 0–5% by weight of an alkali metal salt of the at least one polyanionic complexing agent;
(E) 3–15% by weight sodium carbonate;
(F) 0–5% by weight sodium hydroxide;
(G) 0.5–5% by weight of sodium silicate having an $Na_2O$:$SiO_2$ ratio of from 1:3 to 1:3.5;
(H) 0.5–3% by weight of an active chlorine providing composition;
(I) 0.01 to 2.0% by weight of the at least one chlorine-stable, foam inhibiting ketone.

13. A composition of claim 12 containing from 0.05 to 0.5% by weight of the at least one chlorine-stable, foam inhibiting ketone.

14. A composition of claim 12 wherein the active chlorine providing composition comprises at least one compound selected from the group consisting of trichloroisocyanuric acid, sodium dichloroisocyanurate and potassium dichloroisocyanurate.

15. A process for the preparing a detergent of claim 1 which comprises mixing with the dry detergent ingredient a dispersion of the ketone in liquid.

16. A process of claim 15 wherein the dispersion of the ketone comprises an organic liquid.

17. A process of claim 15 wherein the detergent ingredients are in a granular form., 18. Process of claim 16 wherein the organic liquid comprises at least one composition selected from the group consisting of mineral oil having a boiling point above about 140° C. and branched chain fatty alcohol having from 8 to about 24 carbon atoms.

19. A process of claim 15 wherein the ketone comprises from about 5 to about 15% of the dispersion.

* * * * *

UNITED STATES PATENT AND TRADEMARK OFFICE

CERTIFICATE OF CORRECTION

PATENT NO. : 4,937,011

DATED : June 26, 1990

INVENTOR(S) : Karl-Heinz Schmid et al.

It is certified that error appears in the above-identified patent and that said Letters Patent is hereby corrected as shown below:

In Claim 1, at Col. 7, line 25 "0-2%" should read --0-20%--.

Signed and Sealed this

Seventeenth Day of December, 1991

*Attest:*

HARRY F. MANBECK, JR.

*Attesting Officer*

*Commissioner of Patents and Trademarks*